US008899494B2

(12) United States Patent
Bunker et al.

(10) Patent No.: US 8,899,494 B2
(45) Date of Patent: Dec. 2, 2014

(54) BI-DIRECTIONAL FUEL INJECTION METHOD

(75) Inventors: Ronald Scott Bunker, Waterford, NY (US); Andrei Tristan Evulet, Florence (IT)

(73) Assignee: General Electric Company, Niskayuna, NY (US)

( * ) Notice: Subject to any disclaimer, the term of this patent is extended or adjusted under 35 U.S.C. 154(b) by 916 days.

(21) Appl. No.: 13/077,719

(22) Filed: Mar. 31, 2011

(65) Prior Publication Data

US 2012/0248217 A1 Oct. 4, 2012

(51) Int. Cl.

| | |
|---|---|
| ***B05B 9/00*** | (2006.01) |
| ***F23R 3/28*** | (2006.01) |
| ***F23R 3/30*** | (2006.01) |
| ***F23R 3/14*** | (2006.01) |

(52) U.S. Cl.

CPC ..... *F23R 3/30* (2013.01); *F23R 2900/00014* (2013.01); *F23R 2900/03281* (2013.01); *F23R 3/286* (2013.01); *F23D 2209/10* (2013.01); *F23C 2900/07001* (2013.01); *F23R 3/14* (2013.01)

USPC ..... 239/125; 239/126

(58) Field of Classification Search

CPC ..... B05B 15/04; B05B 15/0406

USPC ..... 239/125, 126, 589.1, 433, 434

See application file for complete search history.

(56) References Cited

U.S. PATENT DOCUMENTS

| | | | | |
|---|---|---|---|---|
| 4,790,480 | A * | 12/1988 | Rennie | 239/125 |
| 5,569,029 | A * | 10/1996 | Poschl | 431/116 |
| 6,895,758 | B2 | 5/2005 | Knight | |
| 7,128,082 | B1 | 10/2006 | Cerretelli et al. | |
| 7,669,405 | B2 | 3/2010 | Pinard et al. | |
| 7,832,212 | B2 | 11/2010 | Bunker | |
| 2007/0237627 | A1 | 10/2007 | Bunker | |
| 2008/0104961 | A1 | 5/2008 | Bunker | |
| 2008/0134685 | A1 | 6/2008 | Bunker et al. | |
| 2010/0011770 | A1 | 1/2010 | Chila et al. | |
| 2010/0068066 | A1 | 3/2010 | Bunker | |
| 2010/0123031 | A1 | 5/2010 | Weber | |
| 2011/0005334 | A1 | 1/2011 | Haynes et al. | |
| 2011/0030375 | A1 | 2/2011 | Bunker | |

FOREIGN PATENT DOCUMENTS

| | | |
|---|---|---|
| EP | 1331447 | 7/2003 |

* cited by examiner

*Primary Examiner* — Davis Hwu
(74) *Attorney, Agent, or Firm* — Ann M. Agosti

(57) ABSTRACT

In certain embodiments, a fuel injector includes a wall separating a fuel passage from an air passage. The fuel injector also includes a fuel injection port extending from a first side of the wall to a second side of the wall for injecting a flow of fuel from the fuel passage into a flow of air in the air passage. In addition, the fuel injector includes first and second feedback lines extending from a downstream end of the fuel injection port to an upstream end of the fuel injection port. The first and second feedback lines are disposed on opposite sides of the fuel injection port. In addition, the first and second feedback lines are disposed entirely within the wall.

16 Claims, 9 Drawing Sheets

BI-DIRECTIONAL FUEL INJECTION METHOD

BACKGROUND OF THE INVENTION

The subject matter disclosed herein relates to fuel nozzles and, more specifically, to fuel nozzles having passive bi-directional oscillating fuel injection ports.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., electrical generator. As appreciated, a flame may develop in a combustion zone having a combustible mixture of fuel and air. Unfortunately, the flame can potentially propagate upstream from the combustion zone into the fuel nozzle, which can result in damage due to the heat of combustion. This phenomenon is generally referred to as flashback Likewise, the flame can sometimes develop on or near surfaces, which can also result in damage due to the heat of combustion. This phenomenon is generally referred to as flame holding. For example, the flame holding may occur on or near a fuel nozzle in a low velocity region. In particular, an injection of a fuel flow into an air flow may cause a low velocity region near the injection point of the fuel flow, which can lead to flame holding. In addition, conventional combustion systems are often characterized by high degrees of acoustic coupling, whereby heat releases in the combustor generate certain magnitudes of dynamic pressure at predominant frequencies that may cause detrimental effects to the combustor.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a fuel nozzle includes a fuel passage through which a fuel flows, an air passage through which air flows, and a wall separating the fuel passage from the air passage. The wall includes at least one fuel injection port extending from a first side of the wall to a second side of the wall for injecting the flow of fuel into the flow of air. The wall also includes first and second feedback lines extending from a downstream end of the fuel injection port to an upstream end of the fuel injection port. The first and second feedback lines are disposed on opposite sides of the fuel injection port. In addition, the first and second feedback lines are disposed entirely within the wall.

In a second embodiment, a fuel injector includes a wall separating a fuel passage from an air passage. The fuel injector also includes a fuel injection port extending from a first side of the wall to a second side of the wall for injecting a flow of fuel from the fuel passage into a flow of air in the air passage. In addition, the fuel injector includes first and second feedback lines extending from a downstream end of the fuel injection port to an upstream end of the fuel injection port. The first and second feedback lines are disposed on opposite sides of the fuel injection port. In addition, the first and second feedback lines are disposed entirely within the wall.

In a third embodiment, a method includes injecting a main flow of fuel along a central axis of a fuel injection port. In addition, the method includes passively inducing a first feedback flow of fuel through a first feedback line extending from a downstream end on a first side of the fuel injection port to an upstream end on the first side of the fuel injection port. The first feedback flow of fuel creates a pressure field that forces the main flow of fuel toward a second side of the fuel injection port opposite the first side.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments include systems and methods for passively inducing bi-directional oscillating fuel injection in combustion systems, such as in pre-mixed combustion systems for gas turbines. The embodiments described herein include fuel injection ports, each having a diffuser section disposed in a wall, and two pressure feedback lines on opposite sides of the fuel injection port. When the fuel attaches to one of the sides of the fuel injection port, a feedback flow is generated through the pressure feedback line on that side of the fuel injection port, such that a high pressure is created at the outlet of the pressure feedback line, thereby forcing the fuel stream back toward the opposite wall. This process repeats in an alternating manner, thereby creating the bi-directional oscillating nature of the fuel stream. The resulting oscillating fuel injection jet is output from the diffuser section of the fuel injection port without detachment and flame holding. In addition, the self-oscillating (i.e., passive) nature of the fuel injection decouples the fuel injection acoustics from other acoustic excited modes in the combustor. Furthermore, since each fuel injection port may have a different oscillating frequency by varying dimensions (i.e., shapes, sizes, orientations, and so forth) of the fuel injection ports, the probability of any acoustic driven coupling is relatively small.

Figure 1:
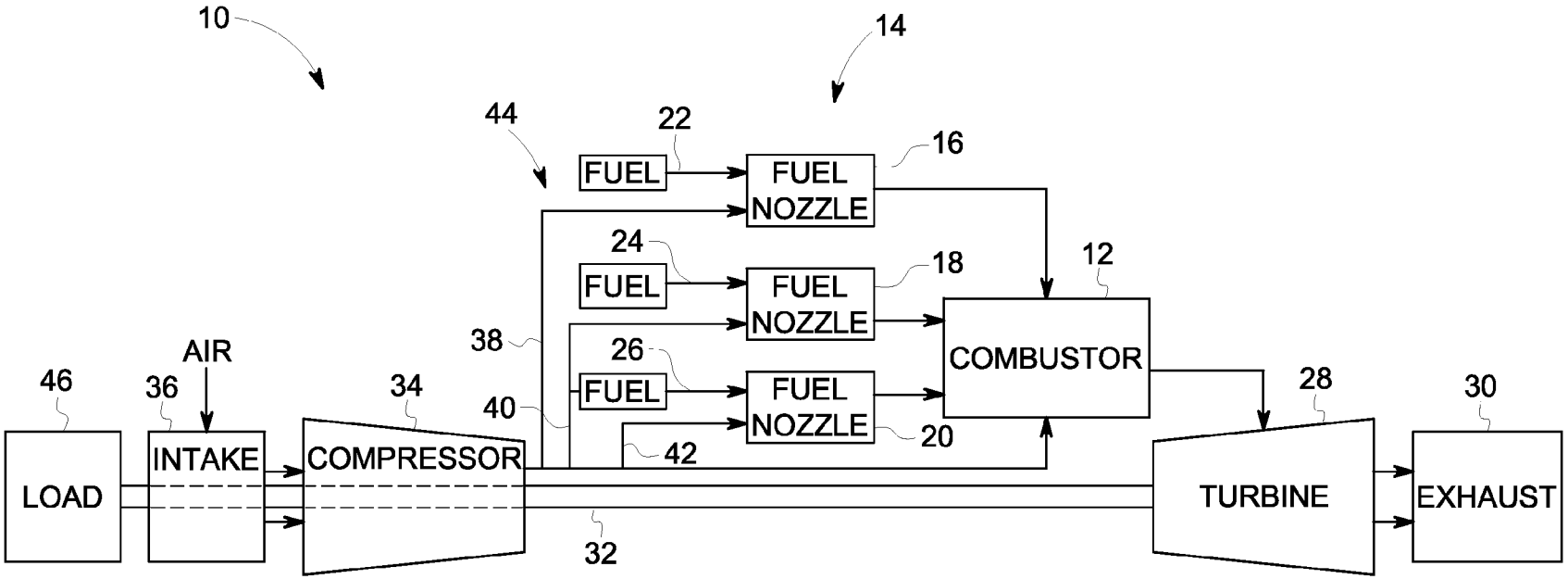
FIG. 1 is a schematic flow diagram of an embodiment of a turbine system having a combustor with a plurality of fuel nozzles, which may include bi-directional fuel injection ports.

FIG. 1 is a schematic flow diagram of an embodiment of a turbine system 10 having a combustor 12 with a plurality of fuel nozzles 14. As illustrated, the plurality of fuel nozzles 14 may include first, second, and third fuel nozzles 16, 18, 20. However, in certain embodiments, the plurality of fuel nozzles 14 may include 2, 4, 5, 6, 7, 8, 9, 10, 11, 12, or even more fuel nozzles 14. The turbine system 10 may use liquid or gas fuel, such as natural gas and/or a hydrogen rich synthetic gas. As depicted, the fuel nozzles 14 intake a plurality of fuel supply streams 22, 24, 26. Each of the fuel supply streams 22, 24, 26 may mix with a respective air stream, and be distributed as an air-fuel mixture into the combustor 12. More specifically, as described in greater detail below, each of the fuel nozzles 14 may include passive bi-directional oscillating fuel injection features to facilitate the creation of oscillating fluid jets of the fuel into the air, thereby reducing the possibility of ignition and flame holding at locations where the fuel mixes with the air.

The air-fuel mixture combusts in a chamber within the combustor 12, thereby creating hot pressurized exhaust gases. The combustor 12 directs the exhaust gases through a turbine 28 toward an exhaust outlet 30. As the exhaust gases pass through the turbine 28, the gases force one or more turbine blades to rotate a shaft 32 along an axis of the turbine system 10. As illustrated, the shaft 32 may be connected to various components of the turbine system 10, including a compressor 34. The compressor 34 also includes blades that may be coupled to the shaft 32. As the shaft 32 rotates, the blades within the compressor 34 also rotate, thereby compressing air from an air intake 36 through the compressor 34 and into the fuel nozzles 14 and/or combustor 12. More specifically, a first compressed air stream 38 may be directed into the first fuel nozzle 16, a second compressed air stream 40 may be directed into the second fuel nozzle 18, and a third compressed air stream 42 may be directed into the third fuel nozzle 20. However, again, any number of compressed air streams 44 may be directed into the plurality of respective fuel nozzles 14. The shaft 32 may also be connected to a load 46, which may be a vehicle or a stationary load, such as an electrical generator in a power plant or a propeller on an aircraft, for example. The load 46 may include any suitable device capable of being powered by the rotational output of turbine system 10.

Figure 2:
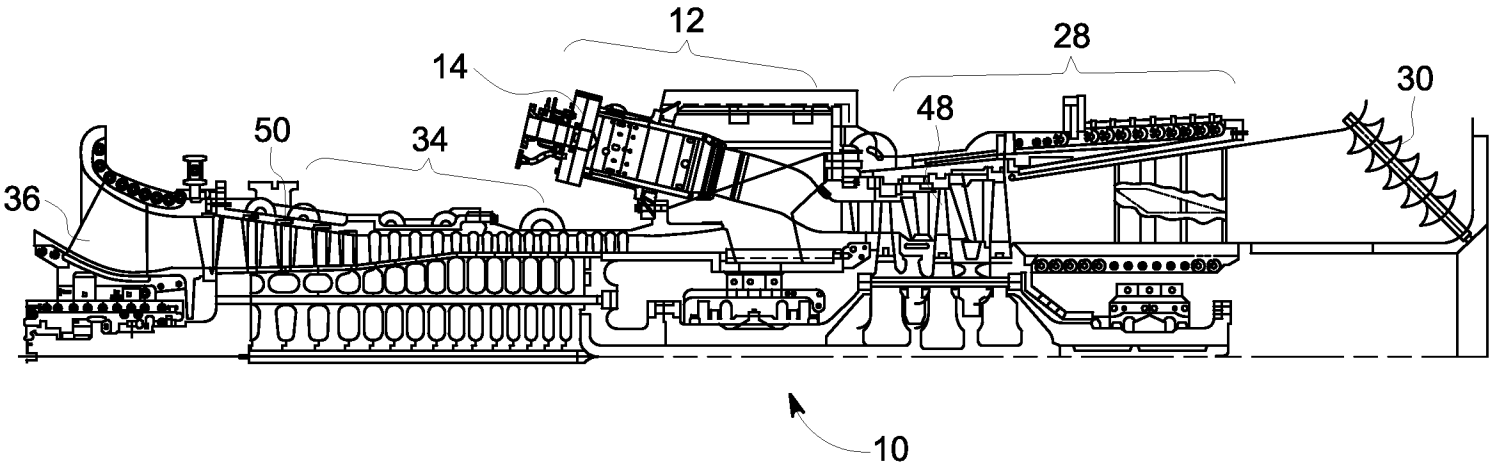
FIG. 2 is a cross-sectional side view of an embodiment of the turbine system, as illustrated in FIG. 1.

FIG. 2 is a cross-sectional side view of an embodiment of the turbine system 10, as illustrated in FIG. 1. The turbine system 10 includes one or more fuel nozzles 14 located inside one or more combustors 12. In operation, air enters the turbine system 10 through the air intake 36 and is pressurized in the compressor 34. The compressed air may then be mixed with fuel for combustion within the combustor 12 using the fuel nozzles 14 having the bi-directional fuel injection ports described herein. For example, the fuel nozzles 14 may inject a fuel-air mixture into the combustor 12 in a suitable ratio for optimal combustion, emissions, fuel consumption, and power output. The combustion generates hot pressurized exhaust gases, which then drive one or more blades 48 within the turbine 28 to rotate the shaft 32 and, thus, the compressor 34 and the load 46. The rotation of the turbine blades 48 causes a rotation of the shaft 32, thereby causing blades 50 within the compressor 34 to draw in and pressurize the air received by the air intake 36.

Figure 3:
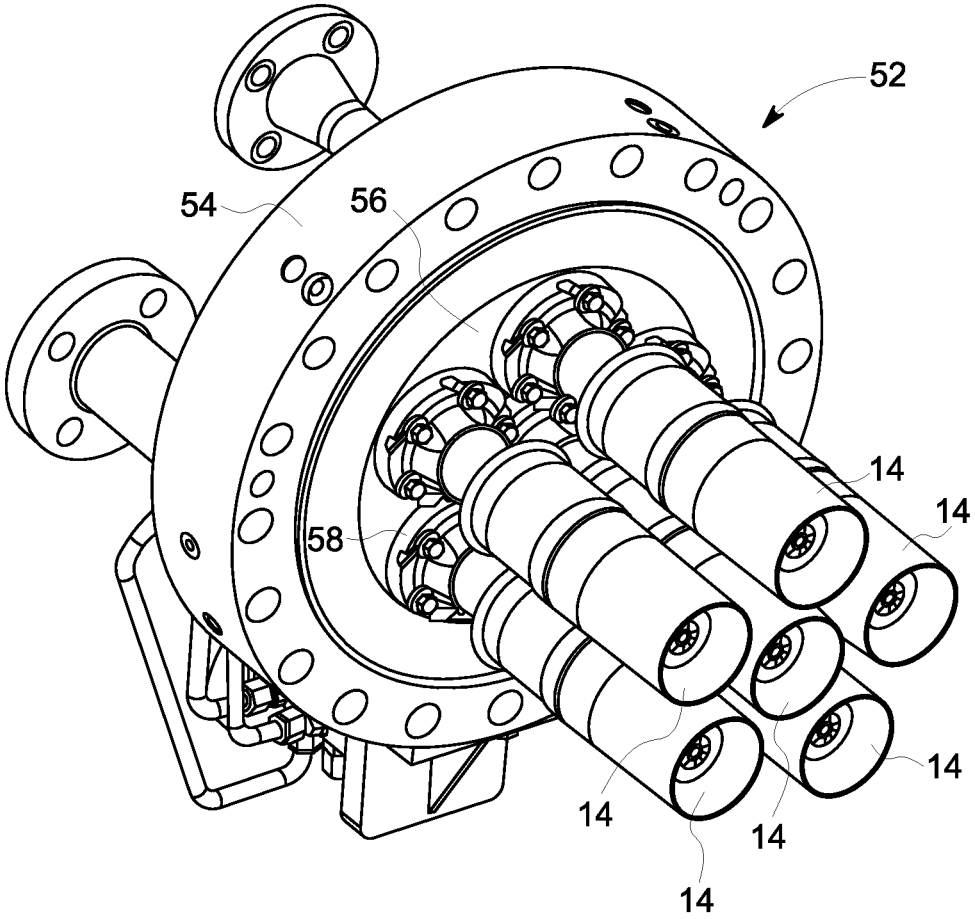
FIG. 3 is a perspective view of an embodiment of a combustor head end of a combustor of the gas turbine engine, as shown in FIG. 2, illustrating the plurality of fuel nozzles.

FIG. 3 is a detailed perspective view of an embodiment of a combustor head end 52 having an end cover 54 with the plurality of fuel nozzles 14 attached to an end cover base surface 56 via sealing joints 58. The head end 52 routes the compressed air from the compressor 34 and the fuel through the end cover 54 to each of the fuel nozzles 14, which at least partially pre-mix the compressed air and fuel as an air-fuel mixture prior to entry into a combustion zone in the combustor 12. As described in greater detail below, each fuel nozzle 14 may include a swirling mechanism (e.g., one or more swirl vanes) configured to induce swirl in an air-fuel mixture (or, in certain circumstances, only air) in a direction. In addition, as also described in greater detail below, the fuel nozzles 14 may include bi-directional fuel injection features to facilitate the creation of oscillating fluid jets of the fuel into the air.

Figure 4:
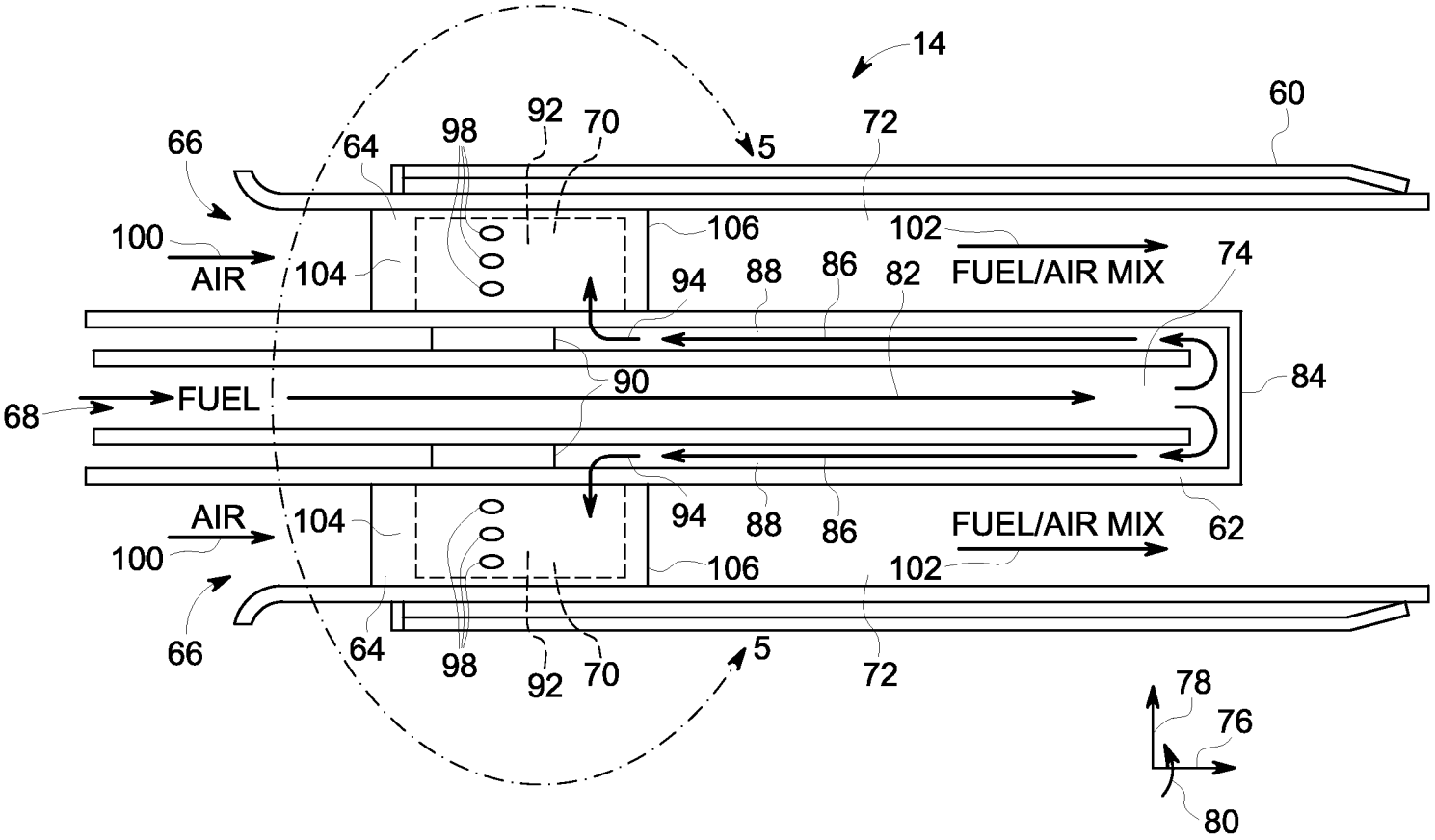
FIG. 4 is a cross-sectional side view of an embodiment of a fuel nozzle, as shown in FIG. 3.

FIG. 4 is a cross-sectional side view of an embodiment of the fuel nozzles 14 of FIG. 3. In the illustrated embodiment, the fuel nozzle 14 includes an outer peripheral wall 60 and a nozzle center body 62 disposed within the outer peripheral wall 60. The outer peripheral wall 60 may be described as a burner tube, whereas the nozzle center body 62 may be described as a fuel supply tube. The fuel nozzle 14 also includes an air-fuel pre-mixer 64, an air inlet 66, a fuel inlet 68, swirl vanes 70, a mixing passage 72 (e.g., annular passage for mixing air and fuel), and a fuel passage 74. The swirl vanes 70 are configured to induce swirling flow within the fuel nozzle 14. It should be noted that various aspects of the fuel nozzle 14 may be described with reference to an axial direction or axis 76, a radial direction or axis 78, and a circumferential direction or axis 80. For example, the axis 76 corresponds to a longitudinal centerline or lengthwise direction, the axis 78 corresponds to a crosswise or radial direction relative to the longitudinal centerline, and the axis 80 corresponds to the circumferential direction about the longitudinal centerline.

As illustrated, fuel may enter the nozzle center body 62 through the fuel inlet 68 into the fuel passage 74. The fuel may travel axially 76 in a downstream direction, as noted by arrow 82, through the entire length of the nozzle center body 62 until it impinges upon an interior end wall 84 (e.g., a downstream end portion) of the fuel passage 74, whereupon the fuel reverses flow, as indicated by arrow 86, and enters a reverse flow passage 88 in an upstream axial direction. For purposes of discussion, the term downstream may represent a direction of flow of the combustion gases through the combustor 12 toward the turbine 28, whereas the term upstream may represent a direction away from or opposite to the direction of flow of the combustion gases through the combustor 12 toward the turbine 28.

At the axially 76 extending end of the reverse flow passage 88 opposite the end wall 84, the fuel impinges upon wall 90 (e.g., upstream end portion) and travels into an outlet chamber 92 (e.g., an upstream cavity or passage), as indicated by arrow 94. The fuel is expelled from the outlet chamber 92 through fuel injection ports 98 in the swirl vanes 70, where the fuel mixes with air flowing through the mixing passage 72 from the air inlet 66, as illustrated by arrow 100. For example, the fuel injection ports 98 may inject the fuel crosswise to the air flow to induce mixing. Likewise, the swirl vanes 70 induce a swirling flow of the air and fuel, thereby increasing the mixture of the air and fuel. In addition, as described in greater detail below, the fuel injection ports 98 may be configured to facilitate bi-directional fuel injection of the fuel into the flow of air. The air-fuel mixture exits the air-fuel pre-mixer 64 and continues to mix as it flows through the mixing passage 72, as indicated by arrow 102. This continuing mixing of the air and fuel through the mixing passage 72 allows the air-fuel mixture exiting the mixing passage 72 to be substantially fully mixed when it enters the combustor 12, where the mixed air and fuel may be combusted.

Figure 5:
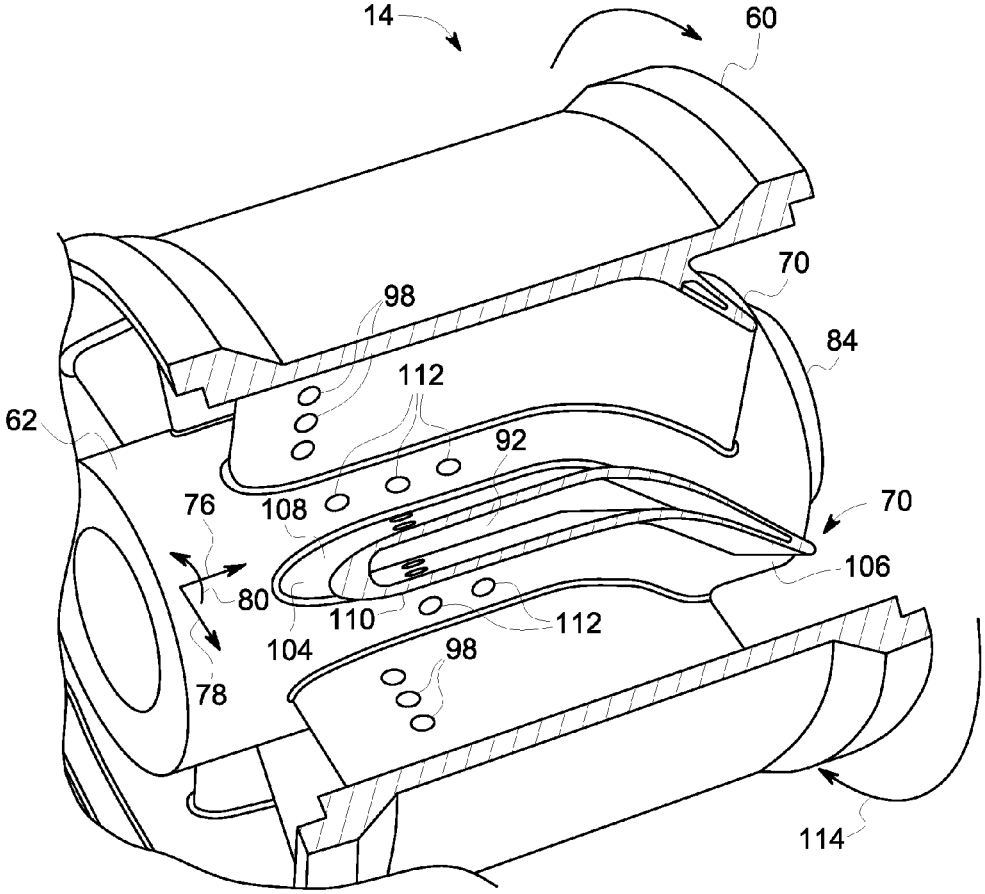
FIG. 5 is a perspective cutaway view of an embodiment of the fuel nozzle, as shown in FIG. 4.

FIG. 5 is a perspective cutaway view of an embodiment of the fuel nozzle 14 taken within arcuate line 5-5 of FIG. 4. The fuel nozzle 14 includes the swirl vanes 70 disposed circumferentially around the nozzle center body 62, wherein the swirl vanes 70 extend radially outward from the nozzle center body 62 to the outer peripheral wall 60. As illustrated, each swirl vane 70 is a hollow body (e.g., a hollow airfoil shaped body) having the outlet chamber 92 from which fuel may be injected into the flow of air. The fuel travels upstream to the outlet chamber 92, and then exits the outlet chamber 92 through the fuel injection ports 98.

The swirl vanes 70 are configured to swirl the flow, and thus induce air-fuel mixing, in a circumferential direction 80 about the axis 76. As illustrated, each swirl vane 70 bends or curves from an upstream end portion 104 to a downstream end portion 106. In particular, the upstream end portion 104 is generally oriented in an axial direction along the axis 76, whereas the downstream end portion 106 is generally angled, curved, or directed away from the axial direction along the axis 76. As a result, the downstream end portion 106 of each swirl vane 70 biases or guides the flow into a rotational path about the axis 76 (e.g., swirling flow). This swirling flow enhances air-fuel mixing within the fuel nozzle 14 prior to delivery into the combustor 12. Each swirl vane 70 may include the fuel injection ports 98 on first and/or second sides 108, 110 of the swirl vane 70. The first and second sides 108, 110 may combine to form the outer surface of the swirl vane 70. For example, the first and second sides 108, 110 may define an airfoil shaped surface.

Therefore, as described above, the physical shape of the swirl vanes 70 of the fuel nozzle 14 may induce swirling of the air-fuel mixture in a circumferential direction about the longitudinal centerline of the fuel nozzle 14, as indicated by arrow 114. More specifically, the downstream end portion 106 of each swirl vane 70 may bias or guide the air-fuel mixture into a rotational path about the axis 76 (e.g., swirling flow). Although illustrated in FIG. 5 as inducing counter-clockwise rotational swirling relative to the axis 76, in other embodiments, the swirling vanes 70 of the fuel nozzle 14 may be designed such that clockwise rotational swirling relative to the axis 76 is induced. Indeed, the bi-directional fuel injection embodiments described herein may be extended to other systems that inject a flow of fuel into a flow of air.

Moreover, in addition to the fuel injection ports 98 of the swirling vanes 70 illustrated in FIGS. 4 and 5, other fuel injection ports of the fuel nozzle 14 may utilize the bi-directional fuel injection techniques described herein. For example, as illustrated in FIG. 5, a plurality of fuel injection ports 112 through the nozzle center body 62 of the fuel nozzle 14 may utilize the bi-directional fuel injection techniques described herein to inject the flow of fuel into the flow of air. As such, the fuel injection ports 98, 112 may be collectively referred to as the bi-directional fuel injection ports 116.

Figure 6:
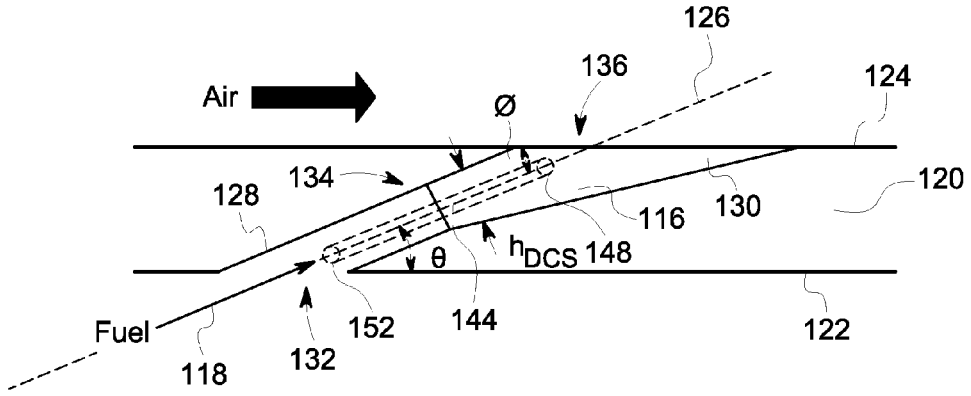
FIG. 6 is a cross-sectional side view of an embodiment of a bi-directional fuel injection port of the fuel nozzles.

FIG. 6 is a cross-sectional side view of an embodiment of a bi-directional fuel injection port 116 (e.g., the fuel injection ports 98, 112) of the fuel nozzles 14 described above. For each of the types of bi-directional fuel injection ports 116 described above, the fuel 118 flows through a wall 120 (e.g., a wall of the swirling vanes 70 for the fuel injection ports 98, and a wall of the nozzle center body 62 for the fuel injection ports 112) from an inner side 122 of the wall 120 to an outer side 124 of the wall 120. As illustrated in FIG. 6, in certain embodiments, the fuel injection port 116 may have a central axis 126 of fuel flow that is angled with respect to the wall 120. In other words, the central axis 126 of fuel flow is not orthogonal to the wall 120, extending generally perpendicular to the inner and outer sides 122, 124 of the wall 120. Rather, the central axis 126 of fuel flow may be aligned at an angle θ from both the inner and outer sides 122, 124 of the wall 120. For example, in certain embodiments, the angle θ may be approximately 15, 20, 25, 30, 35, 40, or 45 degrees, or even greater. However, in other embodiments, the bi-directional fuel injection techniques may be extended to fuel injection ports 116 that are aligned substantially orthogonally to the wall 120.

In addition, in certain embodiments, the fuel injection port 116 may include more than one cross-sectional section. In other words, the cross-sectional area of the fuel injection port 116 along the central axis 126 of fuel flow may not be constant. More specifically, as illustrated in FIG. 6, the fuel injection port 116 may include an upstream cross-sectional section 128 and a downstream cross-sectional section 130. In general, the upstream cross-sectional section 128 may extend from an upstream end 132 (i.e., an inlet) of the fuel injection port 116 to a central point 134 along the central axis 126 of fuel flow of the fuel injection port 116, whereas the downstream cross-sectional section 130 may extend from the central point 134 along the central axis 126 of fuel flow of the fuel injection port 116 to a downstream end 136 (e.g., an outlet) of the fuel injection port 116.

In certain embodiments, the upstream cross-sectional section 128 of the fuel injection port 116 may be substantially constant. More specifically, in certain embodiments, the upstream cross-sectional section 128 may be a substantially constant circular area (e.g., varying only within a range of approximately ±10%, ±5%, ±2%, ±1%, or even less). However, in other embodiments, the upstream cross-sectional section 128 may be a substantially constant oval area. In addition, in other embodiments, the upstream cross-sectional section 128 may not be substantially constant. For example, the upstream cross-sectional section area 128 may gradually increase along the central axis 126 of fuel flow.

Figure 7:
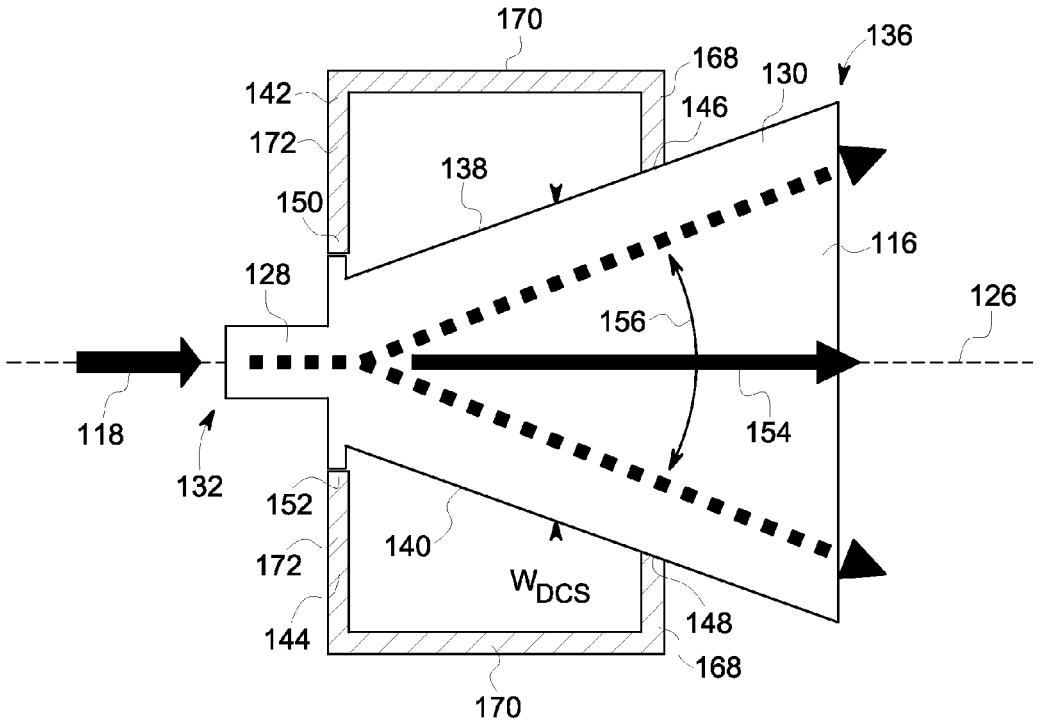
FIG. 7 is a cross-sectional top view of an embodiment of the bi-directional fuel injection port taken along a central axis of fuel flow illustrated in FIG. 6.

Similarly, as illustrated in FIG. 6, the downstream cross-sectional section 130 may generally increase (i.e., function as a diffuser section) along the central axis 126 of fuel flow toward the downstream end 136 (e.g., the outlet) of the fuel injection port 116. More specifically, the height $h_{DCS}$ of the downstream cross-sectional section 130 may gradually increase (i.e., diverge) along the central axis 126 of fuel flow toward the downstream end 136 of the fuel injection port 116. FIG. 7 is a cross-sectional top view of an embodiment of the bi-directional fuel injection port 116 taken along the central axis 126 of fuel flow illustrated in FIG. 6. As illustrated, the width $w_{DCS}$ of the downstream cross-sectional section 130 may increase (i.e., diverge) significantly more from a first side 138 of the fuel injection port 116 to a second side 140 of the fuel injection port 116 than the height $h_{DCS}$ of the downstream cross-sectional section 130 along the central axis 126 of fuel flow toward the downstream end 136 of the fuel injection port 116.

As illustrated in FIG. 7, the fuel injection port 116 may be in fluid connection with first and second pressure feedback lines 142, 144, which are disposed entirely within the wall 120. The first pressure feedback line 142 is on the first side 138 of the fuel injection port 116 and the second pressure feedback line 144 is on the second side 140 of the fuel injection port 116. Both the first and second pressure feedback lines 142, 144 include respective pressure feedback inlets 146, 148 and pressure feedback outlets 150, 152. As illustrated, in certain embodiments, the fuel injection port 116 comprises a single, continuous fuel passage having a single inlet and a single outlet for injecting a main fuel flow stream 154 into the flow of air. Similarly, in certain embodiments, the first and second pressure feedback lines 142, 144 both comprise a single, continuous fuel feedback passage having a single inlet and a single outlet for feeding back a portion of the main fuel flow stream 154.

In certain embodiments, the pressure feedback inlets 146, 148 and the pressure feedback outlets 150, 152 are all substantially orthogonal to the central axis 126 of the main fuel flow stream 154. As described in greater detail below, a portion of the main fuel flow stream 154 may feed back through the first and second pressure feedback lines 142, 144 in an alternating manner (e.g., first through the first pressure feedback line 142, then through the second pressure feedback line 144, and so forth) to ensure that the main fuel flow stream 154 does not hold against either side 138, 140 of the fuel injection port 116. Rather, by ensuring that the main fuel flow stream 154 does not hold against either side 138, 140 of the fuel injection port 116, the first and second pressure feedback lines 142, 144 may cause the main fuel flow stream 154 to oscillate back and forth between the first and second sides 138, 140 of the fuel injection port 116, as illustrated by arrows 156. As such, the fuel injection port 116 is a bi-directional fuel injection port, which generates a bi-directional oscillating fluidic jet of the main fuel flow stream 154.

Figure 8A:
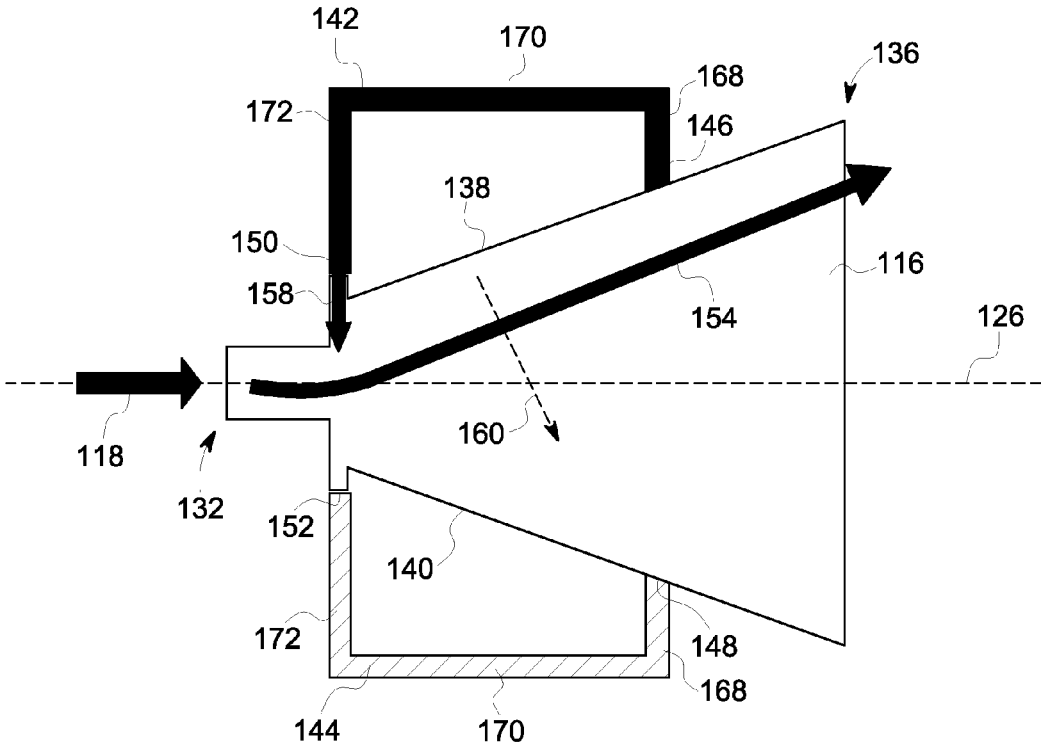
FIGS. 8A and 8B are cross-sectional top views of an embodiment of the bi-directional fuel injection port as illustrated in FIG. 7, illustrating the functionality of first and second pressure feedback lines.
Figure 8B:
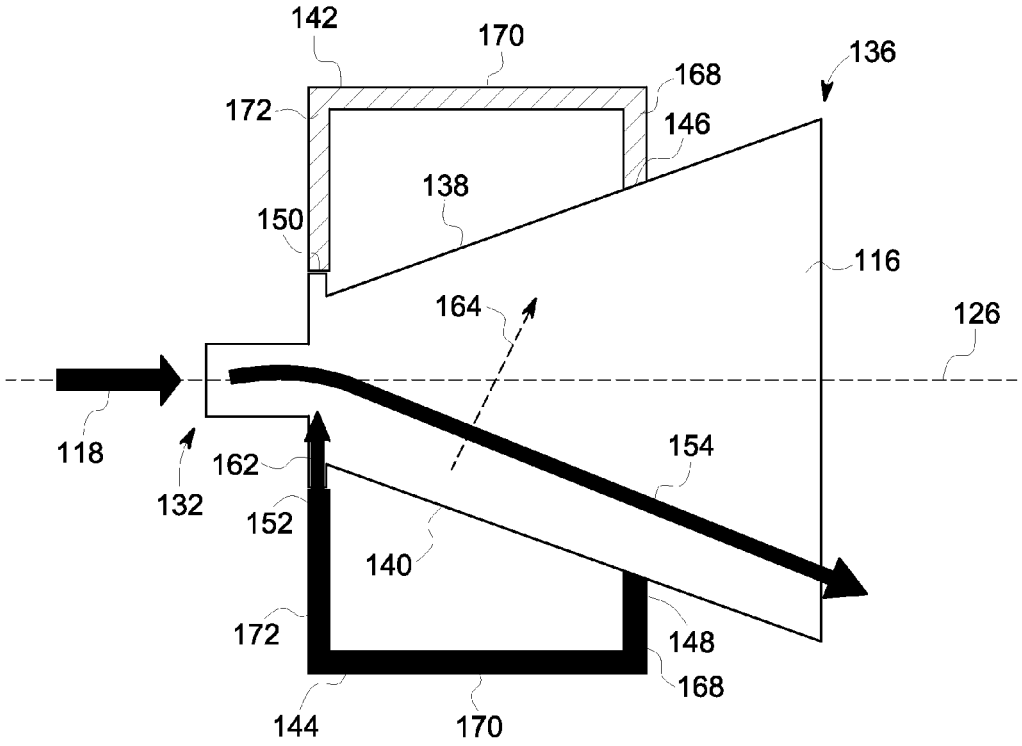

For example, FIGS. 8A and 8B are cross-sectional top views of an embodiment of the bi-directional fuel injection port 116 as illustrated in FIG. 7, illustrating the functionality of the first and second pressure feedback lines 142, 144. As illustrated in FIG. 8A, when the main fuel flow stream 154 attaches to the first side 138 of the fuel injection port 116, a portion of the main fuel flow stream 154 may be induced by a pressure recovery field in the first pressure feedback line 142 to enter the pressure feedback inlet 146 along the first side 138 and exit the pressure feedback outlet 150 along the first side 138. As such, a secondary fuel flow stream (i.e., a first pressure feedback stream 158) may be induced back through the first pressure feedback line 142. When the first pressure feedback stream 158 exits through the pressure feedback outlet 150 along the first side 138 of the fuel injection port 116, the first pressure feedback stream 158 applies pressure against the main fuel flow stream 154 generally orthogonal to the central axis 126. As such, the main fuel flow stream 154 may be forced back toward the central axis 126 by the first pressure feedback stream 158, as illustrated by arrow 160. Indeed, the main fuel flow stream 154 may ultimately be forced all the way back toward the second side 140 of the fuel injection port 116. It is the recovery pressure inside the first pressure feedback line 142 that causes the high pressure at the pressure feedback outlet 150 along the first side 138 of the fuel injection port 116. As such, the first pressure feedback line 142 is sized large enough (i.e., with sufficient volume, diameter, and so forth) to ensure that the pressure recovery (i.e., due to lower velocities) in the first pressure feedback line 142 is realized from the dynamic pressure in the fuel injection port 116.

As illustrated in FIG. 8B, when the main fuel flow stream 154 attaches to the second side 140 of the fuel injection port 116, a portion of the main fuel flow stream 154 may be induced by a pressure recovery field in the second pressure feedback line 144 to enter the pressure feedback inlet 148 along the second side 140 and exit the pressure feedback outlet 152 along the second side 140. As such, a secondary fuel flow stream (i.e., a second pressure feedback stream 162) may be induced back through the second pressure feedback line 144. When the second pressure feedback stream 162 exits through the pressure feedback outlet 152 along the second side 140 of the fuel injection port 116, the second pressure feedback stream 162 applies pressure against the main fuel flow stream 154 generally orthogonal to the central axis 126. As such, the main fuel flow stream 154 may be forced back toward the central axis 126 by the second pressure feedback stream 162, as illustrated by arrow 164. Indeed, the main fuel flow stream 154 may ultimately be forced all the way back toward the first side 138 of the fuel injection port 116. It is the recovery pressure inside the second pressure feedback line 144 that causes the high pressure at the pressure feedback outlet 152 along the second side 140 of the fuel injection port 116. As such, the second pressure feedback line 144 is sized large enough (i.e., with sufficient volume, diameter, and so forth) to ensure that the pressure recovery (i.e., due to lower velocities) in the second pressure feedback line 144 is realized from the dynamic pressure in the fuel injection port 116.

As such, returning now to FIG. 7, in addition to ensuring that the main fuel flow stream 154 does not attach to the sides 138, 140 of the fuel injection port 116, the first and second pressure feedback lines 142, 144 also passively create an oscillating bi-directional fluidic jet (i.e., illustrated by arrows 156) of the main fuel flow stream 154 such that the main fuel flow stream 154 mixes more efficiently with the air stream. In other words, without the use of a separate control system (e.g., to actively vary the flow rate, direction, and so forth of the main fuel flow stream 154), the first and second pressure feedback lines 142, 144 passively create the bi-directional oscillating nature of the main fuel flow stream 154. In addition, the bi-directional oscillations created by the first and second pressure feedback lines 142, 144 also dampen acoustic coupling effects within the combustor 12. In conventional fuel injection techniques, all fuel injection ports generate substantially similar combustion acoustics due to the fact that the fuel injection ports are generally similarly shaped and oriented.

However, the first and second pressure feedback lines 142, 144 described herein may be sized and shaped to create different frequencies of oscillation. For example, in general, the cross-sectional areas of both the first and second pressure feedback lines 142, 144 are substantially constant across the length of the first and second pressure feedback lines 142, 144. In addition, the cross-sectional areas and the lengths of both the first and second pressure feedback lines 142, 144 are substantially similar to ensure that the oscillations between the first and second sides 138, 140 of the fuel injection port 116 occur at generally the same frequencies. However, both the cross-sectional areas and the lengths of the first and second pressure feedback lines 142, 144 associated with the fuel injection ports 116 may be varied between fuel injection ports 116 to create different frequencies of oscillation for the fuel injection ports 116. Generally speaking, higher recovered pressure is obtained by larger cross-sectional areas of the first and second pressure feedback lines 142, 144. In addition, the lengths of the first and second pressure feedback lines 142, 144 may be varied as an additional parameter to modify the frequency of oscillation for a given fuel injection port 116.

As such, for any given fuel injection port 116, the cross-sectional areas and/or the lengths of the associated first and second pressure feedback lines 142, 144 may be varied to tune the frequency of oscillation for the fuel injection port 116. In certain embodiments, the cross-sectional areas and/or the lengths of the first and second pressure feedback lines 142, 144 may be sized based on an expected flow rate of the main fuel flow stream 154 through the fuel injection port 116. Furthermore, returning now to FIG. 5, the cross-sectional areas and/or lengths of the first and second pressure feedback lines 142, 144 for all of the fuel injection ports 116 (e.g., the fuel injection ports 98, 112) of a given fuel nozzle 14 may be modified to ensure that none of the fuel injection ports 116 have exactly the same frequency of oscillation. Furthermore, in certain embodiments, all of the various oscillation frequencies for the fuel injection ports 116 may be designed to not coincide with the combustion frequencies present in the combustor 12. As described above, in conventional combustion systems, heat releases in the combustor generate certain magnitudes of dynamic pressure at predominant frequencies that can cause detrimental effects to the combustor. These pressure oscillations can be acoustically coupled to the upstream fuel injection, causing a detrimental feedback loop that varies the fuel injection flow rate. By having a range of fuel injection oscillation frequencies, while still at relatively constant fuel flow rates, the system is acoustically decoupled.

Figure 9A:
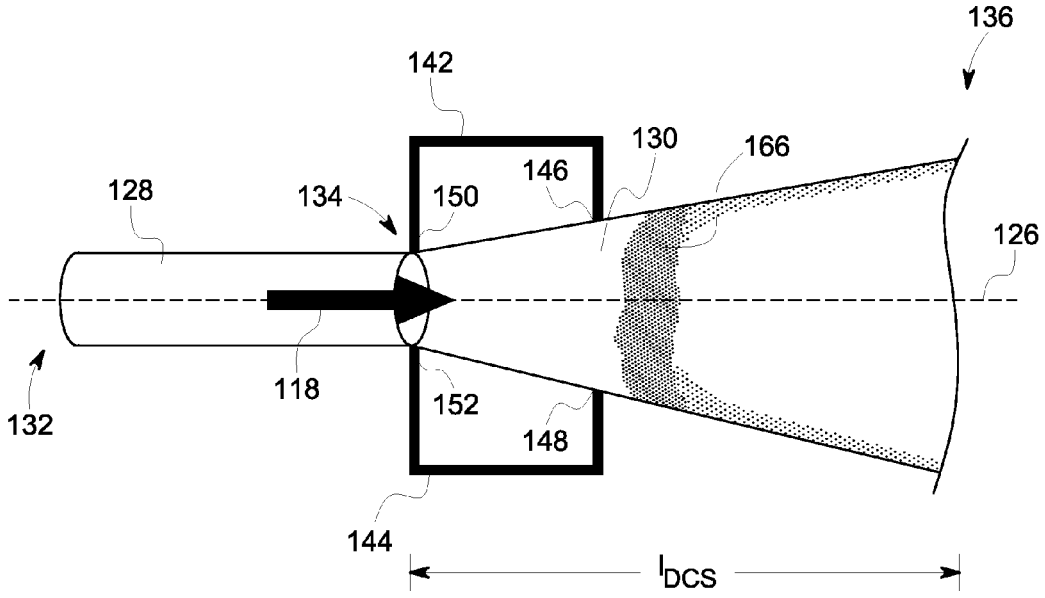
FIGS. 9A and 9B are cross-sectional top views of an embodiment of the bi-directional fuel injection port as illustrated in FIG. 7, illustrating varying lengths of the bi-directional fuel injection port.
Figure 9B:
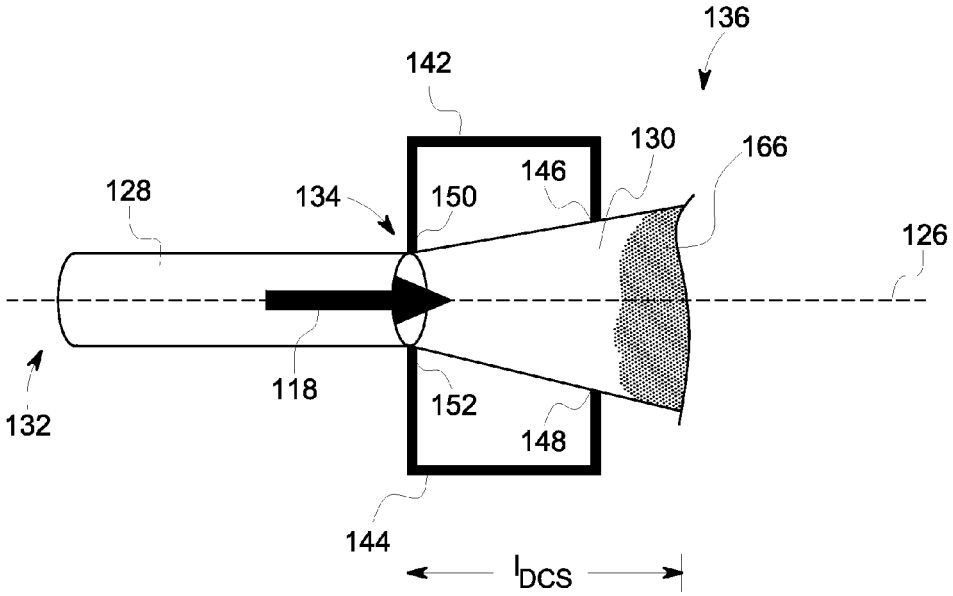

In addition, the effects of strong acoustic coupling may be further mitigated by varying the total length of the fuel injection port 116 along the central axis 126. For example, FIGS. 9A and 9B are cross-sectional top views of an embodiment of the bi-directional fuel injection port 116 as illustrated in FIG. 7, illustrating varying lengths of the bi-directional fuel injection port 116. More specifically, as illustrated in FIGS. 9A, the length $l_{DCS}$ of the downstream cross-sectional section 130 of the fuel injection port 116 may be varied. In particular, in the embodiment illustrated in FIG. 9A, the length $l_{DCS}$ of the downstream cross-sectional section 130 is relatively long with the pressure feedback inlets 146, 148 farther away from the downstream end 136. Conversely, in the embodiment illustrated in FIG. 9B, the length $l_{DCS}$ of the downstream cross-sectional section 130 is relatively short with the pressure feedback inlets 146, 148 closer to the downstream end 136.

As such, the length $l_{DCS}$ of the downstream cross-sectional section 130 of the fuel injection port 116 is relatively long and, as such, a fully diffused flow regime 166 (e.g., caused by the bi-directional oscillating nature of the main fuel flow stream 154) occurs farther away from the downstream end 136 than in the embodiment illustrated in FIG. 9B, where the length $l_{DCS}$ of the downstream cross-sectional section 130 is relatively small. As such, by varying the length $l_{DCS}$ of the downstream cross-sectional section 130 of the fuel injection port 116, the location of the fully diffused flow regime 166 may be varied, and the mixing dynamics with the flow of air may also be varied.

Returning now to FIG. 7, as described above, in certain embodiments, the pressure feedback inlets 146, 148 and the pressure feedback outlets 150, 152 of the pressure feedback lines 142, 144 associated with the fuel injection ports 116 are all substantially orthogonal to the central axis 126 of the main fuel flow stream 154. In addition, in the embodiments illustrated in FIGS. 7, 8A, 8B, 9A, and 9B, both of the first and second pressure feedback lines 142, 144 include three substantially orthogonal sections 168, 170, 172. However, in other embodiments, the first and second pressure feedback lines 142, 144 may be shaped differently than three substantially orthogonal sections 168, 170, 172. For example, in other embodiments, the first and second pressure feedback lines 142, 144 may be rounded, such as circular or oval, with the end points (e.g., the pressure feedback inlets 146, 148 and the pressure feedback outlets 150, 152) of the circular or oval shapes still be substantially orthogonal to the central axis 126 of the main fuel flow stream 154.

In certain embodiments, the walls 120 are rapid prototyped such that the fuel injection ports 116 and associated first and second pressure feedback lines 142, 144 are not drilled into the walls 120. As such, the varying shapes of the upstream and downstream cross-sectional sections 128, 130 of the fuel injection ports 116 and the varying shapes (e.g., varying cross-sectional areas and/or lengths) of the first and second pressure feedback lines 142, 144 are more easily created in the walls 120. Furthermore, the rapid prototyping also facilitates the modification of the cross-sectional areas and lengths of the upstream and downstream cross-sectional sections 128, 130 of the fuel injection ports 116 and the first and second pressure feedback lines 142, 144 to vary the oscillation acoustics among the various fuel injection ports 116 as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fuel nozzle, comprising:

a fuel passage through which a fuel flows;

an air passage through which air flows; and a wall separating the fuel passage from the air passage, wherein the wall comprises:

at least one fuel injection port extending from a first side of the wall to a second side of the wall for injecting the flow of fuel into the flow of air; and first and second feedback lines extending from a downstream end of the fuel injection port to an upstream end of the fuel injection port, wherein the first and second feedback lines are disposed on opposite sides of the fuel injection port, and wherein the first and second feedback lines are disposed entirely within the wall, wherein the first and second feedback lines are configured to passively induce feedback flows of fuel through the first and second feedback lines in an alternating manner such that the flow of fuel through the fuel injection port oscillates from side to side of the fuel injection port.

2. The fuel nozzle of claim 1, wherein a cross-sectional area of the fuel injection port increases from the upstream end to the downstream end.

3. The fuel nozzle of claim 1, wherein the first and second feedback lines each comprise first and second ends that are substantially orthogonal to a central axis of the flow of fuel, wherein the first end is proximate to the downstream end of the fuel injection port and the second end is proximate to the upstream end of the fuel injection port.

4. The fuel nozzle of claim 3, wherein the first and second feedback lines comprise only substantially orthogonal sections from the first end to the second end.

5. The fuel nozzle of claim 3, wherein the first and second feedback lines comprise rounded sections from the first end to the second end.

6. The fuel nozzle of claim 1, wherein cross-sectional areas of the first and second feedback lines are sized based upon an expected fuel flow rate through the fuel injection port.

7. The fuel nozzle of claim 1, wherein lengths of the first and second feedback lines are sized based upon an expected fuel flow rate through the fuel injection port.

8. The fuel nozzle of claim 1, wherein the wall comprises a plurality of fuel injection ports, and wherein cross-sectional areas of the first and second feedback lines associated with the fuel injection ports vary between fuel injection ports.

9. The fuel nozzle of claim 1, wherein the wall comprises a plurality of fuel injection ports, and wherein lengths of the first and second feedback lines associated with the fuel injection ports vary between fuel injection ports.

10. The fuel nozzle of claim 1, wherein a central axis of the flow of fuel through the fuel injection port is angled with respect to the wall.

11. A fuel injector, comprising:

a wall separating a fuel passage from an air passage;

a fuel injection port extending from a first side of the wall to a second side of the wall for injecting a flow of fuel from the fuel passage into a flow of air in the air passage; and first and second feedback lines extending from a downstream end of the fuel injection port to an upstream end of the fuel injection port, wherein the first and second feedback lines are disposed on opposite sides of the fuel injection port, and wherein the first and second feedback lines are disposed entirely within the wall, wherein the first and second feedback lines are configured to passively induce feedback flows of fuel through the first and second feedback lines in an alternating manner such that the flow of fuel through the fuel injection port oscillates from side to side of the fuel injection port.

12. The fuel injector of claim 11, wherein the first and second feedback lines each comprise first and second ends that are substantially orthogonal to a central axis of the flow of fuel, wherein the first end is proximate to the downstream end of the fuel injection port and the second end is proximate to the upstream end of the fuel injection port.

13. The fuel injector of claim 11, wherein the wall comprises a plurality of fuel injection ports, and wherein cross-sectional areas or lengths of the first and second feedback lines associated with the fuel injection ports vary between fuel injection ports.

14. The fuel injector of claim 11, wherein the cross-sectional area of the fuel injection port increases from the upstream end to the downstream end, and wherein a central axis of the flow of fuel through the fuel injection port is angled with respect to the wall.

15. A fuel injector, comprising:

a wall separating a fuel passage from an air passage;

a fuel injection port extending from a first side of the wall to a second side of the wall for injecting a flow of fuel from the fuel passage into a flow of air in the air passage; and first and second feedback lines extending from a downstream end of the fuel injection port to an upstream end of the fuel injection port, wherein the first and second feedback lines are disposed on opposite sides of the fuel injection port, and wherein the first and second feedback lines are disposed entirely within the wall, wherein the first and second feedback lines each comprise first and second ends that are substantially orthogonal to a central axis of the flow of fuel, wherein the first end is proximate to the downstream end of the fuel injection port and the second end is proximate to the upstream end of the fuel injection port.

16. A fuel injector, comprising:

a wall separating a fuel passage from an air passage;

a fuel injection port extending from a first side of the wall to a second side of the wall for injecting a flow of fuel from the fuel passage into a flow of air in the air passage; and first and second feedback lines extending from a downstream end of the fuel injection port to an upstream end of the fuel injection port, wherein the first and second feedback lines are disposed on opposite sides of the fuel injection port, and wherein the first and second feedback lines are disposed entirely within the wall, wherein the cross-sectional area of the fuel injection port increases from the upstream end to the downstream end, and wherein a central axis of the flow of fuel through the fuel injection port is angled with respect to the wall.

* * * * *